United States Patent [19]

Spencer

[11] Patent Number: 4,906,972

[45] Date of Patent: Mar. 6, 1990

[54] COMMUNICATION SYSTEM FOR HAZARDOUS AREAS

[75] Inventor: Donald W. Spencer, Monroe, Wash.

[73] Assignee: The Boeing Company, Seattle, Wash.

[21] Appl. No.: 43,842

[22] Filed: Apr. 29, 1987

[51] Int. Cl.[4] ..... G08B 1/08; G08B 23/00

[52] U.S. Cl. ..... 340/539; 340/573; 340/304; 340/502; 340/825.45

[58] Field of Search ..... 340/539, 573, 825.47, 340/304, 305, 306, 502, 504, 506, 568, 825.44, 825.69, 825.45

[56] References Cited

U.S. PATENT DOCUMENTS

| | | | |
|---|---|---|---|
| 2,710,345 | 6/1955 | Stephens | 250/17 |
| 2,883,523 | 4/1959 | Meserow | 250/6 |
| 3,087,117 | 4/1963 | Mitchell | 325/118 |
| 3,163,856 | 12/1964 | Kirby | 340/279 |
| 3,588,858 | 6/1971 | Demuth | 340/224 |
| 3,737,782 | 6/1973 | Pierce | 325/363 |
| 3,824,472 | 7/1974 | Engel et al. | 325/355 |
| 3,877,001 | 9/1975 | Bogut et al. | 340/249 |
| 3,914,692 | 10/1975 | Seaborn Jr. | 340/501 |
| 3,968,435 | 7/1976 | Stover | 325/16 |
| 3,970,940 | 7/1976 | Venn | 325/363 |
| 4,045,663 | 8/1977 | Young | 240/10.6 CH |
| 4,057,790 | 11/1977 | Fleming et al. | 340/224 |
| 4,083,003 | 4/1978 | Haemmig | 325/6 |
| 4,092,643 | 5/1978 | Stolarczyk | 340/416 |
| 4,196,429 | 4/1980 | Davis | 340/573 |
| 4,296,408 | 4/1981 | Neuringer | 340/539 |
| 4,331,953 | 5/1982 | Blevins et al. | 340/539 |
| 4,371,827 | 2/1983 | Mullersman et al. | 320/48 |
| 4,377,003 | 3/1983 | Abe et al. | 455/90 |
| 4,404,549 | 9/1983 | Berg | 340/574 |
| 4,468,656 | 8/1984 | Clifford et al. | 340/539 |
| 4,532,501 | 7/1985 | Hoffman | 340/679 |
| 4,665,385 | 5/1987 | Henderson | 340/539 |

FOREIGN PATENT DOCUMENTS

| | | |
|---|---|---|
| 0010003 | 4/1980 | France . |
| 2549262 | 1/1985 | France . |
| 1176460 | 1/1970 | United Kingdom . |

OTHER PUBLICATIONS

Ellis Cohen, "Strathclyde Firemand Alarm", June 1979, Technical Article, U. K. Publication.

W. Hickson and G. Blevins, "Communication System for Confined Hazardous Areas", *Outreach*, Jan./Feb. 1981, p. 1.

*Primary Examiner*—Joseph A. Orsino
*Assistant Examiner*—Frank M. Scutch III
*Attorney, Agent, or Firm*—Dellett, Smith-Hill & Bedell

[57] ABSTRACT

A safety communications system for personel employed in hazardous areas is responsive to motion sensing, as well as to worker initiated check-in signals, for registering an alarm at a central station after an absence of input for a predetermined time period. Confirmation of check-in and emergency transmission is also provided to the worker as assurance of system operation and to provide a local alarm to guide rescue efforts.

21 Claims, 2 Drawing Sheets

COMMUNICATION SYSTEM FOR HAZARDOUS AREAS

BACKGROUND OF THE INVENTION

The present invention relates to a communication system for hazardous areas and particularly to a system characterized by enhanced reliability.

Access by manufacturing or maintenance personnel to hazardous confined areas should be accompanied by particularly exacting safety precautions. In some states, a worker entering a toxic or flammable atmosphere is required to wear a safety harness with a lifeline attached by means of which a second worker will be immediately informed of an accident and will be able to effect rescue.

In some instances, where the complexity of a structure being manufactured does not permit the use of complex harnesses and the like, electronic communications equipment has been used in monitoring a worker's status. An advantageous system is set forth in Blevins et al, U.S. Pat. No. 4,331,953, entitled "Communication System for Use In Hazardous Confined Areas". According to this system, a worker entering a hazardous area carries a portable transmitter having a call-in button and an alarm button. As long as the worker periodically actuates the call-in button, and does not actuate the alarm signal, a central station will be notified of his safety. On the other hand if the worker either depresses the alarm button, or fails to call in within a predetermined time, an alarm is registered at the central station location such that rescue operations can be initiated. According to an additional feature of this system, the worker in the hazardous area is given a preliminary warning signal before his periodic call-in is due, to provide a reminder and prevent false alarms by unintended failure to report in. While the foregoing system is very effective, some difficulty has been experienced regarding false alarms, level of worker confidence, and the reluctance to spend the time required to use the system especially for short periods. In the prior system, the individual worker was not given first hand information on whether the equipment was working and he was actually being tracked by a central station, and whether information in the form of call-ins or alarm signals were being received. Sometimes a transmitter unit would be left at the entry of a hazardous area, i.e., one having close quarters, resulting in a false alarm at the end of a predetermined reporting period at which time the worker was either not available to report in, or could not hear the locally generated signal warning indicating the end of his call-in period was approaching. Furthermore, in some hazardous areas call-in would be prevented by structures shielding the transmission of radio waves causing a false alarm to be generated at the central station despite proper call-in procedure. The worker would be notified neither of reception of his call-in, his alarm, or of a false alarm condition if one occurred. Of course, periodic false alarms tend to lessen the significance of a legitimate alarm condition.

Furthermore, it was conventional in the prior system to provide a call-in period of approximately thirty minutes. Unfortunately in the worst case situation thirty minutes could elapse after a life threatening emergency before the central station was notified. However, requiring very frequent call-ins would be unduly burdensome and less likely to receive worker cooperation.

Emergency warning systems are known which are based upon detection of bodily movement. For example, a fireman may wear a motion detector system which emits an audible alarm if the fireman remains motionless for a predetermined time. The lack-of-motion condition may even be transmitted via radio to a second location. However, a motion sensor of this type provides no information if the unit is faulty, i.e., the lack of a warning therefrom does not necessarily indicate the absence of an emergency. Moreover, life threatening situations can occur in a manufacturing environment despite the presence of motion, e.g., on a moving structure or in the case of abnormal, involuntary movement on the part of the worker.

SUMMARY OF THE INVENTION

In accordance with the present invention in a preferred embodiment thereof, a central monitoring station and a plurality of remote stations are each provided with transmitter-receivers. The remote transmitter can forward an emergency or alarm signal to a central receiver for registering an alarm, or an alarm may be registered in the absence of check-in by a worker within a predetermined period of time. The remote unit provides a warning signal before such predetermined period has elapsed whereby the worker is reminded to call in. In the event the worker using the remote unit depresses either the alarm button or the call-in button, a corresponding acknowledgement signal is transmitted by the central station to the remote unit. Thus, the worker is assured of being tracked by the system and can call in (more often than is dictated by elapsed time) to affirm system operation before entering a hazardous area, or he may call in after entrance into the hazardous area to make certain his radio transmissions are being received. Furthermore, in the event an alarm condition is registered at the central station, the remote unit is immediately notified by way of a local alarm for assurance of system operation and to enable rescue workers to find the location of the unit initiating the alarm. For the latter purpose, the acknowledgement signal is continued for an extended period of time and at a higher volume level. Also, if the alarm was an unintended false alarm either expressly given, or as a result of the expiration of the call-in period, the worker is immediately notified, and can take steps to cancel the alarm.

The system of the present invention advantageously includes a motion sensor for initiating an automatic alarm after a relatively short period of time during which the worker is apparently motionless. According to this aspect of the system, an automatic call-in period is established, for example five minutes in duration, within which some movement on the part of the worker must be registered at the central station before an alarm is begun. According to this system, an inoperative remote station apparatus produces the same alarm as a motionless worker and thus the system is failsafe. The alarm registered at the central station is transmitted back to the remote unit so that corrective action can be taken in the case of false alarm, and so that the remote unit is more easily found in the case of rescue operations. It will be noted that even in the case of a remote unit that is undergoing motion despite an emergency situation, an alarm will be provided after the time out of the more extended time period. The use of the motion sensor provides better safety not only by more continuous monitoring but also by tending to enforce the continuous wearing of the worker units.

In accordance with another aspect of the present invention the remote units are each provided with key pads so the actual location of the remote unit can be indicated to the central station.

In accordance with a further aspect of the present invention the central station normally physically receives the remote units when not in use, and is provided with a charging system for charging the battery or power supply on each of the remote units. An indicator, associated with the repository for each remote unit, notifies the prospective user whether or not the unit is properly charged.

In accordance with yet another feature of the present invention the central and remote units are respectively adapted to effect voice communication by means of their transmitter-receivers. Therefore the worker in an emergency situation can communicate his actual condition to the central station or can answer possible questions which would expedite his rescue. Alternatively, an unintended alarm can be corrected in this manner. Also, the central station can communicate with multiple remote stations for providing emergency information, for example, relating to total evacuation of a manufacturing area.

It is accordingly an object of the present invention to provide an improved communication system for confined hazardous areas.

It is further object of the present invention to provide an improved communication system for confined hazardous areas characterized by reliability and a higher level of confidence.

It is further object of the present invention to provide an improved communication system for confined hazardous areas which promotes continuous use and is less prone to false alarms.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

Drawings

FIG. 1 is a block diagram of a communication system according to the present invention, and FIG. 2 is a perspective view of a central monitoring station according to the communication system of the present invention.

DETAILED DESCRIPTION

Figure 1:
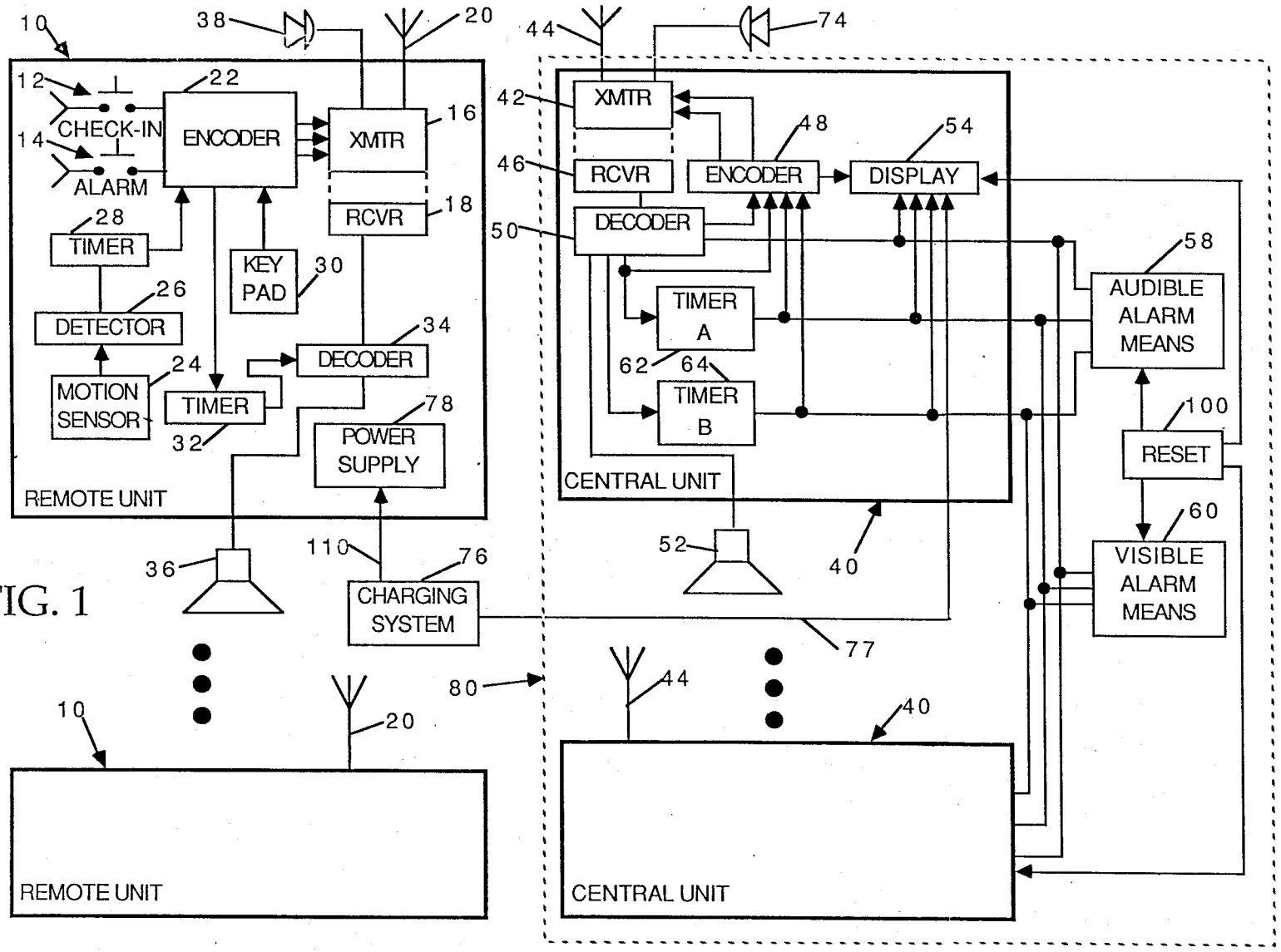
Figure 2:
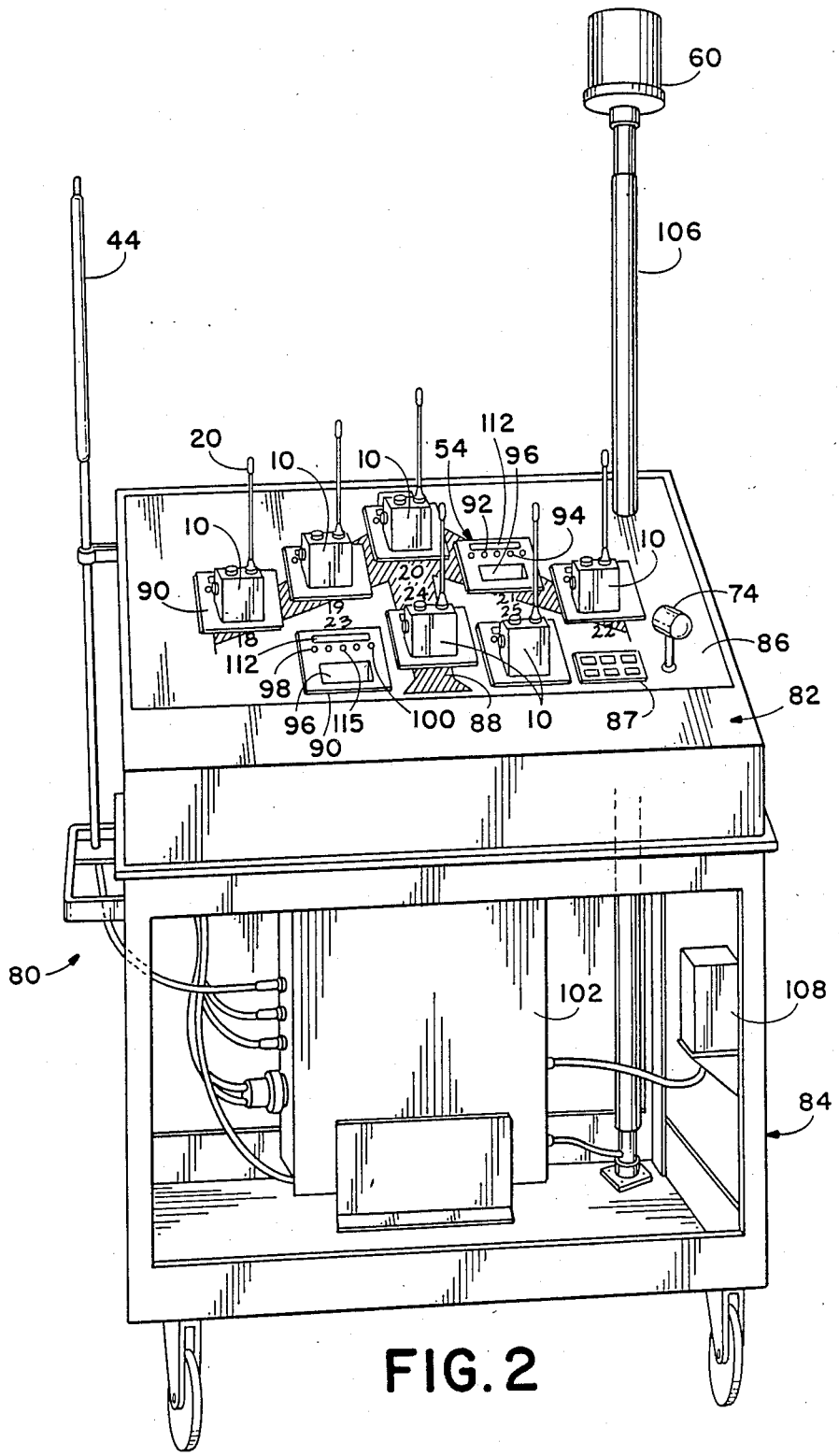

Referring to the drawings and particularly to FIG. 1, depicting the system of the present invention in block diagram form, a plurality of remote stations, each numbered 10, are adapted to communicate with a single central monitoring station 80 which is physically illustrated in FIG. 2. Each remote station is relatively small in size and is adapted to be worn on the belt or the clothing of a worker before entering a hazardous area, for example before entering fuel tanks in the wing or tail section of an airplane. Each remote unit is provided with a first operator actuable momentary contact switch 12, which is intended for worker depression at periodic check-in intervals, and a second operator actuable momentary contact switch 14 utilized by the operator for the purpose of indicating alarm or emergency conditions. The remote unit further includes a small radio transmitter 16 and a receiver 18 which together form a common unit or transmitter-receiver as known in the art. Depression of check-in switch 12 or alarm switch 14 causes transmitter 16 to emit corresponding identifiable signals via remote unit antenna 20. The switches 12 and 14 are coupled to transmitter 16 by way of encoder 22 suitably supplying a first digitally encoded signal to transmitter 16 in case check-in switch 12 is depressed, and a second digitally encoded signal to transmitter 16 in case alarm switch 14 is depressed. Alternatively, encoder 22 may provide other distinguishable signals such as separate audio tones for modulating the carrier of transmitter 16 to distinguish between switch actuations.

Each remote unit according to the present invention is further advantageously provided with an integral motion sensor 24 suitably comprising a twelve connection mercury switch, for example a Series 2009 switch manufactured by Signal Systems International, Inc. of Holmdel, N.J.. Twelve electrically isolated contacts are spaced 30° apart in a circle around the periphery of the switch and a ball of mercury is located in the center of this circle. For "normal" mounting, the mercury makes electrical connection with none of the contacts. However, any substantial motion will cause the mercury to move and the resistance between various contacts to change. A detector circuit 26 of a known type detects the change of state of continuity or resistance between the contacts. If the array of contacts remains unchanged in electrical connection, the detector provides no output, indicative of lack of motion.

The output of detector 26 is coupled as a third input of encoder 22 via timer 28 and encoder 22 supplies a recognizably different modulation input or the like to transmitter 16 in response to motion detection. Preferably, timer 28 provides an output coupled to encoder 22 approximately one minute after being enabled by any signal from detector 26. Assuming substantially continuous motion, timer 28 will produce an automatic "check-in" signal at one minute intervals, indicative of regular motion, as a third encoded output of transmitter 16.

A fourth input to encoder 22 is provided by manually operable key pad 30 which is coupled to encoder 22 for supplying corresponding digitally encoded information to transmitter 16. As hereinafter more fully described, the key pad can be utilized to identify the actual physical location of the particular remote unit 10.

When check-in switch 12 is momentarily closed, encoder 22 delivers a signal to timer 32 initiating a timing operation. When timer 32 "times out", it supplies an output to decoder and tone generator 34 for producing a first audio tone in local speaker 36. The time out period of timer 32 is adjusted to be less than the time period during which a worker is expected to provide the next check-in signal, assuming the worker is able to do so. As hereinafter more fully explained, the central station 20 will register an alarm condition a short time after the time out of timer 32.

Now considering central station 80 in FIG. 1, the station suitably includes a plurality of central units 40 each including a transmitter 42 adapted to communicate with the receiver 18 in an individual remote unit via antenna 44, and a receiver 46 adapted to communicate with transmitter 16 in an individual remote unit. For example, separate frequencies may be used. Alternatively, the transmitter-receiver 42, 46 may be common to a plurality of central units 40 capable of distinguishing between remote units through the more extensive utilization of central unit encoding and decoding.

Assuming that separate transmitter-receivers 42, 46 are used for each central unit 40, decoder 50 is adapted to distinguish between the respective check-in, alarm, automatic motion sensor check-in, and key pad signals encoded by encoder 22 in a corresponding remote unit. In case of actuation of alarm switch 14 at a remote unit, the corresponding encoded signal, coupled via transmitter 16 and receiver 46, is decoded by decoder 50 which supplies an output directly to display 54 such that the remote station where the alarm button was pressed is identified. Also, decoder 50 provides an output to audible and visible alarm means 58 and 60. As hereinafter more fully described, the audible alarm means at the central station is in the nature of a siren or the like, and the visible alarm means is suitably a strobe light mounted on a pedestal and adapted to attract attention in a high-noise factory area.

In response to depression of the check-in momentary contact switch 12, the encoded indication of which is transmitted by transmitter 16 to receiver 46, decoder 50 resets the timing operation of a timer 62. The time-out period of timer 62 corresponds to the predetermined check-in period during which it is expected the remote check-in will be received; if it is not, that is if timer 62 is allowed to time-out without reset, an output is delivered to display 54 to indicate the identity of the remote unit failing to check in on time, and initiating operation of the audible and visible alarm means. It is noted the time-out-period for timer 62 is longer than the time out period for timer 32 by two or three minutes. Thus, if the period for timer 62 is thirty minutes, then the time-out period for timer 32 can be approximately twenty-eight minutes, thereby supplying the worker ample time to check in before causing an alarm.

Periodic automatic check-in signals, coupled to encoder 22 from motion-sensor timer 28 and delivered via the transmitter 16-receiver 46 path, will cause decoder 50 to reset timer 64. Timer 64 is set to time-out during a time period greater than the timing period of timer 28, but substantially shorter than the time-out period of timer 62. Thus, for example, the time-out period for timer 64 is suitably approximately five minutes. If no automatic check-in signal is delivered within such five-minute period, timer 64 times-out and causes display 54 to initiate an identification of the remote unit where no motion is present, as well as to initiate audible and visible alarms 58 and 60.

Furthermore in accordance with the present invention, when -decoder 50 detects receipt of a check-in signal from the remote station and resets timer 62, the same signal is coupled to encoder 48 for providing a confirmation signal in encoded form, either digitally or by means of audio tone, to transmitter- 42. This confirmation signal is received by receiver 18 in corresponding remote unit 10. Decoder and tone generator 34 coupled to receiver 18 decodes the signal and thereupon energizes speaker 36 to produce an audio tone output or "beep", thereby confirming to the worker the receipt of his check-in signal. (Suitably this confirmation signal is of a different frequency than the reminder or warning signal produced in response to the output from timer 32.) The confirmation signal assures the worker the system is operating, and may be used for example when the worker is entering a hazardous area. This confirmation may also be employed when the worker reaches a hazardous area, to make sure radio communication remains effective and is not shielded by intervening structure.

Upon receipt of a signal at receiver 46 in central unit 40, indicative of momentary depression of alarm switch 14, and upon decoding of the same by decoder 50, a signal is provided to encoder 48 which will generate an output applied to transmitter 42. Receiver 18 in the remote station will receive the last mentioned signal and supply an output decoded by decoder and tone generator 34, for causing speaker 36 to generate a third and somewhat louder continuous tone. The latter confirms to the worker the receipt by the central station of his alarm signal and also is efficacious in guiding rescue workers to the location of the particular remote station. This, of course, is at the same time that the central station provided an alarm. The same alarm confirmation is sent to the remote unit from encoder 48 when an alarm is produced in response to the time-out of timer 62 or the time-out of timer 64. It might be thought the worker would be able to hear the centrally generated alarm at central station 80. However, this is frequently not the case because of remoteness of the central station or because of high manufacturing noise level.

If an alarm resulted from error, the worker can suitably cancel the same by depressing check-in button 12. After an alarm condition, the encoder 48 in central unit 40 interprets the next check-in as a cancellation. Alternatively, voice communication can be established, as hereinafter described, between the remote unit and the central station whereby the worker advises the central station that the alarm condition was caused by error. Thus, false alarm conditions resulting in unnecessary initiation of rescue operations are minimized, resulting in more diligent attention to actual emergency situations. The cancellation of an alarm can be similarly brought about whether the alarm was caused by depression of alarm switch 14, time-out of timer 62, or time-out of timer 64. It should also be noted the addition of the movement sensing tends to discourage lack of use of the remote unit as by laying the remote unit down.

The system according to the present invention is also suitably usable for conventional two-way voice communication between central unit 80 and each of the remote units 10. Thus central unit 20 is provided with a speaker 52 coupled to receiver 46 as well as a microphone 74 connected to transmitter 42. Similarly, receiver 18 is coupled to speaker 36 while transmitter 16 is provided with microphone 38. The channel between a transmitter-receiver at a remote station and a transmitter-receiver at the central station is suitably switched at either the remote station or the central station to switch to the voice communication mode from the normal data transmission mode. A central station may be used to warn all workers in a given area to evacuate immediately, or the central unit may make inquiries about a given worker's progress or condition. Also, the worker may guide the central station pertaining to his whereabouts or may ask for and obtain information.

Central station 80 further includes a charging system 76 adapted to charge power supplies, e.g., batteries, 78, in the remote units when the remote units are stored at the central unit as further described in connection with FIG. 2. The charging system 76 is adapted to supply an indication on lead 77 to the display 54 for a particular remote unit when power supply 78 is sufficiently charged for use. Thus, the worker will pick up and use only a remote unit which has been fully charged.

Turning now to FIG. 2, central station 80 comprises an upper console portion 82 and a lower console portion 84. A control panel 86 forms the upper wall of upper portion 82 and is provided with operator controls 87, for example for initiating voice communication. Control panel 86 has a plan view outline of an aircraft 88 depicted thereon. In the illustrated embodiment, for use in an air-craft manufacturing environment, a plurality of receptacle and indicator units 90 are mounted on the panel 86 arranged at each location of a hazardous work area, for example, on the wings and fuselage of the aircraft. Each receptacle and indicator unit is provided with a display 54 including an indicator light group, e.g., a red indicator light 92 and a green indicator light 94. The red light 92 is suitably provided with a legend "alarm" and the green indicator light 94 is provided with the legend "checked", these lights being responsive to the output from decoder 50 and the inverse of the output from timer A, respectively. A third light, 115, indicates battery charge.

A rectangular aperture 96 is formed in each receptacle and indicator assembly 90 to accommodate entry of a remote unit 10. Each receptacle and indicator unit also has an audio silence switch 98 and an alarm reset switch 100 mounted adjacent the indicator lights. (The function of these switches will be described below.) The circuitry for the central units 40 is housed in an electronics cabinet 102 positioned in the lower section of the central unit and coupled to the control panel by suitable cables. A common antenna 44 is mounted in the upper console portion and extends upwardly.

A strobe light 60 performs the visible alarm function and is located on one end of pedestal 106 which in turn is attached at its other end to the lower console portion 84. The strobe light 60 provides the visual indication of an alarm condition. Preferably the pedestal 106 is long enough to place the strobe light 60 some distance above the central unit at a height that makes its easily visible not only from the immediate area, but also from an area out to a substantial perimeter. The audible alarm function is performed by a bell or siren 108 mounted on a side panel of the lower console portion and also coupled to the electronics cabinet 102 by a suitable cable. Electrical connectors (not shown) are provided at the receptacles 96 adapted to make connection with a remote unit when such remote unit is received in the receptacle. This connection is utilized for battery charging and performs the function indicated by lead 110 is FIG. 1. Also, the alarm functions are disabled by suitable connections when a remote unit is in its receptacle.

The audio silence switch 98 is coupled to bell or siren 108 in such manner that by positioning the audio silence switch, the bell or siren is prevented from sounding for that particular remote unit. It is used to silence the alarm to allow remaining work areas to be monitored while help is being sent to the individual work area where an emergency condition has been indicated. The reset switch 100 on each receptacle and indicator panel is used to reset the alarms and turn off the strobe light and red light on the display when the situation or situations that necessitated the alarm have been cleared.

As hereinbefore indicated, each remote unit is preferably provided with a key pad 30 (FIG. 1) for indicating the presence of the worker in a particular work area. Although ideally the worker picks up a remote unit for the portion of the aircraft depicted on the top of the console, this may not be convenient or the worker may move from one location to another. Depression of a two-digit number on key pad 30 causes encoder 22 to couple the information via transmitter 16 and receiver 46 to decoder 50. Decoder 50, interpreting this signal, supplies the numerical indication to display 54 and in particular to an LCD 112 associated with the particular display so that the general area in which the worker is located can be more readily ascertained.

In operation, the central unit 20 is set up in the general area of concern, for example near an airplane under construction. The remote units 10 are mounted in receptacles 96 within the central unit during periods of non-use. When a worker is to perform some task within a designated hazardous work area, he removes the remote unit assigned to that work area from the upper console. The worker attaches the remote unit to his belt or elsewhere on his clothing so that his bodily movements will thereupon be detected, and the remote unit may be immediately checked as by depressing check-in switch 12 to assure that a confirmation beep is produced in the remote unit.

The worker will be continuously assured of the workability and reliability of the system since he can obtain confirmation from the central unit at any time. Likewise, two-way voice communication is readily established. Furthermore, the worker is notified of unintended alarm conditions and can readily cancel the same.

Since the worker's motion is detected as well as his periodic check-in, the worker's condition is substantially continuously monitored, but not at the expense of monitoring movement alone which could be an artifact of the emergency condition itself or otherwise immaterial to the well being of the worker. Moreover, the use of the motion sensor encourages continuous use of the remote units and discourages laying down or misplacing the same. The generation of an alarm signal at the remote unit as well as at the central unit enables the rescue party to locate the worker more quickly and improve his chances for survival.

As will be apparent to those skilled in the . art, encoding, decoding and timing functions can be carried out by computer means. Thus, encoders 22 and 48, as well as decoders 34 and 50, may be implemented in programmed microprocessor form, and may incorporate the functions of the various timers connected thereto.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. In a safety communications system for workers employed in hazardous areas, including a central station, and at least one remote station adapted to be carried by an individual worker, a transmitter and receiver in said central station, a transmitter and receiver in said remote station, said remote station having alarm signal means actuable by a worker and coupled to the remote transmitter, said alarm signal means being actuable to indicate a first emergency condition to said central station, and said remote station having check-in signal means actuable by said worker and also coupled to the remote transmitter, said check-in signal means being actuable to indicate a normal condition to said central station, said central station having alarm means coupled to the central station receiver and responsive to said indication of a first emergency condition for providing a central alarm, and alarm operating means coupled to the central station receiver and responsive to worker actuation of said check-in signal means, said central station alarm means being responsive to said alarm operating means after a predetermined time period in the absence of worker check-in, said central station being further provided with means coupled to the central station transmitter and responsive to reception of said first emergency condition indication by said central station receiver as well as responsive to absence of worker check-in for a predetermined time period for automatically transmitting a return signal to the remote station originating said indication of said first emergency condition or from which no-check-in was received, and means coupled to the remote station receiver for automatically providing a local confirmation signal to said worker on receipt of said return signal from the central station transmitter.

2. The system according to claim 1 wherein said means coupled to the remote station receiver for automatically providing a local confirmation signal to said worker notifies said worker by providing an audible alarm at said remote station.

3. In a safety communications system for workers employed in hazardous areas, including a central station, and at least one remote station adapted to be carried by an individual worker, a transmitter and receiver in said central station, and a transmitter and receiver in said remote station, said remote station having check-in signal means actuable by said worker and coupled to the remote transmitter, said check-in signal means being actuable to indicate a normal condition to said central station, said central station having alarm means coupled to the central station receiver and responsive to worker actuation of said check-in signal means for bringing about a central alarm after a predetermined time period in the absence of worker check-in, said central station being further provided with means coupled to the central station transmitter and responsive to worker actuation of said check-in means as received at said central station receiver for automatically initiating transmission of a return signal, and means coupled to the remote station receiver for automatically providing a local confirmation signal to said worker on receipt of said return signal from the central station transmitter.

4. In a safety communications system for workers employed in hazardous areas, including a central station and at least one remote station adapted to be carried by an individual worker, a receiver in said central station, and a transmitter in said remote station, said remote station having check-in signal means actuable by said worker and coupled to the remote transmitter, said check-in signal means being actuable to indicate a normal condition to said central station, said central station having alarm means coupled to the central station receiver and responsive to worker actuation of said check-in signal means for bringing about a central alarm after a predetermined time period in the absence of worker check-in, said remote station having motion sensor means, and means responsive to said motion sensor means for sending signals from said remote to said central station indicative of motion as an automatic check-in, wherein central station alarm means provide an alarm in the predetermined absence of motion by said motion sensor means.

5. The system according to claim 4 including timing means in said central station for delaying alarm in the absence of motion indicating signals until said central station receiver fails to receive said motion indicating signals for a predetermined period of time.

6. The system according to claim 5 including further timing means in said remote station for delaying transmission of motion indicating signals to said central station receiver until the expiration of a second predetermined period of time less than said first mentioned period of time.

7. The system according to claim 5 further including a transmitter in said central station and a receiver in said remote station, and means coupled to the central station transmitter and responsive to motion indicating signals from said remote station for automatically producing a return signal to said remote station indicating the predetermined absence of motion.

8. In a safety communications system for workers employed in hazardous areas, including a central station, and at least one remote station adapted to be carried by an individual worker, a receiver in said central station, and a transmitter in said remote station, said remote station having alarm signal means actuable by a worker and coupled to the remote transmitter for indicating an emergency condition to said central station, said central station having alarm means coupled to the central station receiver and responsive to said indication of an emergency condition for providing a central alarm, said remote station having motion sensor means, and means responsive to said motion sensor means for sending signals from said remote to said central station indicative of motion as an automatic check-in, wherein central station alarm means provide an alarm in the predetermined absence of motion by said motion sensor means.

9. The system according to claim 8 including timing means in said central station for delaying alarm in the absence of motion indicating signals until said central station receiver fails to receive said motion indicating signals for a predetermined period of time.

10. The system according to claim 9 including further timing means in said remote station for delaying transmission of motion indicating signals to said central station receiver until the expiration of a second predetermined period of time less than said first mentioned period of time.

11. The system according to claim 9 further including a transmitter in said central station and a receiver in said remote station, and means coupled to the central station transmitter and responsive to motion indicating signals from said remote station for automatically producing a return signal to said remote station indicating the predetermined absence of motion.

12. In a safety communications system for workers employed in hazardous areas, including a central station, and a plurality of remote stations to be carried by individual workers, a transmitter and receiver in said central station, and a transmitter and receiver in said remote station, each remote station having alarm signal means actuable by a worker and coupled to the remote transmitter for indicating a first emergency condition to said central station, check-in signal means actuable by said worker and also coupled to the remote transmitter, said check-in signal means being actuable to indicate a normal condition to said central station, and a timer means responsive to worker actuation of said check-in signal means for bringing about a warning after a predetermined first time period during which a further check-in is expected, said central station having alarm means coupled to the central station receiver and responsive to said indication of a first emergency condition for providing a central alarm, and second timer means coupled to the central station receiver and responsive to worker actuation of said check-in signal means for bringing about a central alarm after a predetermined second time period longer than said first time period in the absence of worker check-in, said central station being further provided with means coupled to the central station transmitter and responsive to reception of said first emergency condition indication by said receiver as well as responsive to absence of worker check-in for a predetermined time period for automatically transmitting a return signal to the remote station originating said indication of said first emergency condition or from which no-check-in was received, and means coupled to the remote station receiver for automatically notifying said worker on receipt of said return signal from the central station transmitter.

13. The system according to claim 12 wherein said means coupled to the remote station receiver notifies said worker by providing an audible alarm at said remote station.

14. The system according to claim 13 wherein said means coupled to the central station transmitter is further automatically responsive to worker actuation of said check-in means as received at said central station receiver for initiating transmission of a second return signal, said means coupled to the remote station receiver automatically providing a local confirmation signal to said worker on receipt of said second return signal from the central station transmitter.

15. The system according to claim 12 wherein a said remote station further includes:

motion sensor means adapted to change its state of electrical connection upon predetermined worker movement, means for detecting said change- in state of electrical connection, and means for coupling said detecting means to said remote station transmitter for sending signals to said central station receiver indicative of motion by said motion sensor means according to said change in state of electrical connection, wherein central station alarm means provides an alarm in the predetermined absence of signals indicative of motion by said motion sensor.

16. The system according to claim 15 including second timing means in said central station for delaying alarm in said absence of motion indicating signals until said central station receiver fails to receive said motion indicating signals for a third predetermined period of time.

17. The system according to claim 16 including further timing means in said remote station for delaying transmission of motion indicating signals to said central station receiver until the expiration of a fourth predetermined period of time less than said third period of time.

18. The system according to claim 16 wherein said means coupled to the central station transmitter and responsive to said first emergency condition as well as to indication of lack of worker check-in is also responsive to said motion indicating signals from said remote station for automatically producing a said return signal to which means coupled to the remote station receiver are responsive for notifying said worker.

19. The system according to claim 12 wherein the transmitter and receiver in said central station and the transmitter and receiver in said remote station are selectively operable to provide voice communication.

20. The system according to claim 12 wherein a said remote station is provided with encoder means and a key pad coupled to said remote station transmitter via said encoder means for communicating locations of said remote station to said central station.

21. The system according to claim 12 wherein said central station is provided with a console for removably receiving remote stations in engaging relation when said remote stations are not in use, said remote stations being further provided with rechargable power means, and said console having charging means therefor operated in charging relation to a remote station placed in said console, and indicating means in said console for displaying when a remote station so received is charged.

* * * * *

UNITED STATES PATENT AND TRADEMARK OFFICE

CERTIFICATE OF CORRECTION

PATENT NO. : 4,906,972

DATED : March 6, 1990

INVENTOR(S) : Donald W. Spencer

It is certified that error appears in the above-identified patent and that said Letters Patent is hereby corrected as shown below:

Column 4, lines 40-41, delete "chec-kin" and substitute --check-in--.

Column 5, line 51, delete "-decoder" and substitute --decoder--.

Column 5, line 55, delete "transmitter-" and substitute --transmitter--.

Column 12, line 10, delete "change-" and substitute --change--.

Signed and Sealed this

Ninth Day of April, 1991

*Attest:*

*Attesting Officer*

HARRY F. MANBECK, JR.

*Commissioner of Patents and Trademarks*